US008596359B2

(12) United States Patent
Grigsby et al.

(10) Patent No.: US 8,596,359 B2
(45) Date of Patent: Dec. 3, 2013

(54) REMOTELY CONTROLLABLE FLUID FLOW CONTROL ASSEMBLY

(75) Inventors: Tommy Frank Grigsby, Katy, TX (US); Timothy Rather Tips, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 99 days.

(21) Appl. No.: 12/907,121

(22) Filed: Oct. 19, 2010

(65) Prior Publication Data

US 2012/0090687 A1 Apr. 19, 2012

(51) Int. Cl.
*E21B 43/04* (2006.01)

(52) U.S. Cl.
CPC ..... *E21B 43/045* (2013.01)
USPC ..... 166/278; 166/51; 166/375

(58) Field of Classification Search
USPC ..... 166/51, 66.6, 278, 334.4, 375
See application file for complete search history.

(56) References Cited

U.S. PATENT DOCUMENTS

| | | | | |
|---|---|---|---|---|
| 5,180,016 | A | 1/1993 | Ross et al. | |
| 5,332,045 | A | 7/1994 | Ross et al. | |
| 5,413,180 | A | 5/1995 | Ross et al. | |
| 6,343,651 | B1 | 2/2002 | Bixenman | |
| 6,782,948 | B2 * | 8/2004 | Echols et al. | 166/278 |
| 2008/0128130 | A1 * | 6/2008 | Whitsitt et al. | 166/278 |
| 2009/0095471 | A1 | 4/2009 | Guignard et al. | |
| 2009/0301732 | A1 | 12/2009 | Turner et al. | |
| 2010/0163235 | A1 | 7/2010 | Mootoo et al. | |

FOREIGN PATENT DOCUMENTS

WO 2012054324 4/2012

OTHER PUBLICATIONS

International Patent Application No. PCT/US2011/056297 , "International Search Report and Written Opinion", mailed Jul. 30, 2012, 14 pages.

International Patent Application No. PCT/US2011/056297 , "Partial Search Report", mailed May 8, 2012, 7 pages.

* cited by examiner

*Primary Examiner* — David Bagnell
*Assistant Examiner* — Richard Alker
(74) *Attorney, Agent, or Firm* — Kilpatrick Townsend & Stockton LLP

(57) ABSTRACT

Fluid flow control assemblies capable of being disposed in a wellbore for hydrocarbon fluid production are described. The fluid flow control assemblies can include valves that are actuated via controls from a component positioned at or near the surface to control direction of fluid flow downhole. Packers can be set, slurry can be circulated to screens, and hydrocarbons can be produced via a single trip through the wellbore.

19 Claims, 6 Drawing Sheets

REMOTELY CONTROLLABLE FLUID FLOW CONTROL ASSEMBLY

TECHNICAL FIELD OF THE INVENTION

The present invention relates generally to fluid flow control assemblies for facilitating subterranean fluid production and, more particularly (although not necessarily exclusively), to valves in assemblies that can control fluid flow direction downhole.

BACKGROUND

Hydrocarbons can be produced through a wellbore traversing a subterranean formation. In some cases, the formation may be unconsolidated or loosely consolidated. Particulate materials, such as sand, from these types of formations may be produced together with the hydrocarbons. Production of particulate materials presents numerous problems. Examples of problems include particulate materials being produced at the surface, causing abrasive wear to components within a production assembly, partially or fully clogging a production interval, and causing damage to production assemblies by collapsing onto part or all of the production assemblies.

Sand control screens can be used to provide stability to a formation to prevent or reduce collapses and to filter particulate materials from hydrocarbon fluids. In a typical sand control screen implementation, such as a gravel or "frac" pack, a completion assembly is run on a service tool downhole. The completion assembly includes a screen, shear sub, blank pipe, a packer assembly, and a bull plug or sump packer seal assembly. The packer is set and the completion assembly is released from the packer. The service tool is manipulated to obtain proper positioning to control fluid flow downhole.

For example, the service tool can be manipulated into a "circulating, live-annulus position" to allow fluid slurry to be pumped into the annulus area formed between the screen and the base pipe. The slurry can include a liquid carrier and particulate material, such as gravel or other proppant. The flow path for slurry to be pumped downhole can include a work string, a crossover port in the completion assembly, a closing sleeve port in the assembly, and a lower annulus between the screen and the base pipe. The particulate material can be deposited in the lower annulus area to form a gavel pack. The gravel pack can be highly permeable for the flow of hydrocarbon fluids but can block the flow of the fine particulate materials carried in the hydrocarbon fluids. The liquid carrier can then flow into the formation or inside of the screen and up the wash pipe where it can be returned through the top port into an upper annulus area.

The service tool can then be manipulated into a "squeeze or test position" in which a seal above the top port is sealed in a packer assembly to stop return flow and force the fluid that is pumped downhole into the formation. The packer can be tested using pressure in the upper annulus.

The service tool can also be manipulated into a "reverse-out position" in which the top port and the crossover port are repositioned to be above the packer. Fluid circulation can occur at the top of the packer, either forward (e.g. down the work string) or reverse (e.g. down the upper annulus). The completion assembly can include a reverse ball check that can prevent fluid losses down the wash pipe into the formation. The service tool is then removed from the bore and the bore is prepared for installation of an uphole production tubing assembly.

Although effective, such implementations require at least two trips downhole—one to set the sand control screen via a work string, and a second to run a production tubing assembly. Furthermore, mechanically positioning the service tool accurately can be difficult, particularly at great depths, such as 25,000 or more feet below sea level, and at high wellbore angles. In addition, components such as a service tool, an upper extension, a closing sleeve, and a casing, may be subjected to erosion during sand control pumping, or otherwise may experience erosion and fail to function properly.

Therefore, assemblies are desirable that can reduce the number trips downhole, facilitate downhole positioning, and/or decrease effects of erosion in a downhole environment.

SUMMARY

Certain embodiments of the present invention are directed to fluid flow control assemblies that are capable of being disposed in a bore and that include valves that are actuated via controls from a component positioned at or near the surface to control direction of fluid flow downhole.

In one aspect, a fluid flow control assembly is described that includes at least one actuator and valves. The actuator can receive signals from a surface component. The valves can be in communication with the actuator and can be controllably actuated by the actuator in accordance with the signals to control direction of fluid flow in the bore.

In another aspect, a method is described for preparing a bore for hydrocarbon production. Production tubing is run in the bore. The production tubing includes a screen, a fluid flow control assembly, and a packer assembly. The fluid flow control assembly includes at least one actuator that can receive signals from a surface component and includes valves in communication with the actuator. In response to signals received from the surface component, the fluid flow control assembly is configured to a circulating position by actuating the valves to an open position to allow slurry to flow to the screen and at least some of the liquid carrier of the slurry to return to an upper portion of the bore. The slurry can also include particulate material. In response to signals received from the surface component, the fluid flow control assembly is configured to a production mode position by actuating the valves to a closed position to allow hydrocarbons to flow to the upper portion of the bore.

In another aspect, a fluid flow control assembly is described that includes at least one actuator and valves in communication with the actuator. The actuator can receive signals from a surface component. The valves can be controllably actuated by the actuator in accordance with the signals to control direction of fluid flow in the bore to allow a packer to be set, slurry to be circulated to a screen, and hydrocarbons to be produced, through a single trip in the bore.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
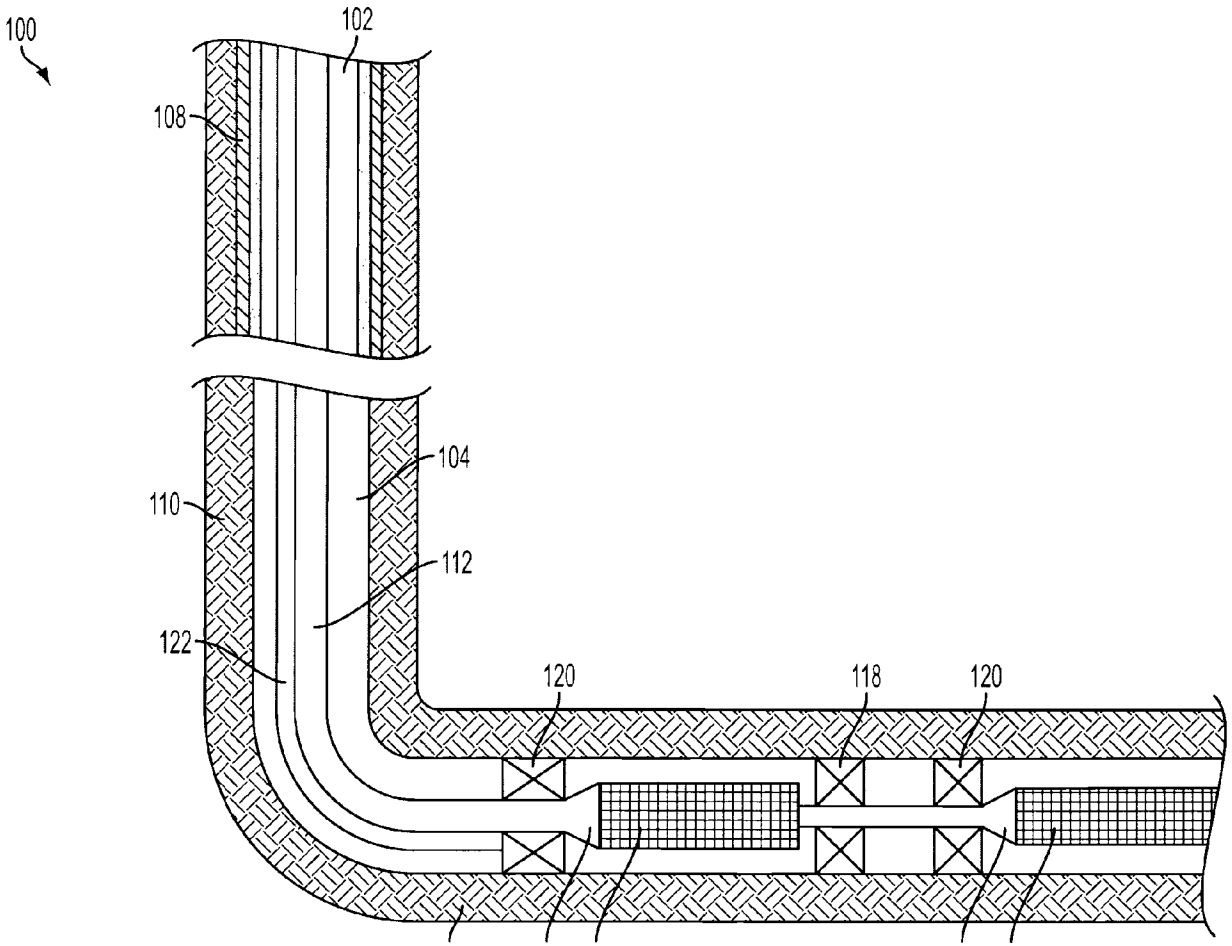
FIG. 1 is a schematic illustration of a well system having fluid flow control assemblies according to one embodiment of the present invention.

Certain aspects and embodiments of the present invention relate to fluid flow control assemblies that are capable of being disposed in a bore, such as a wellbore, of a subterranean formation for use in producing hydrocarbon fluids from the formation. The fluid flow control assemblies can include valves that are actuated via controls from a component positioned at or near the surface to control direction of fluid flow downhole.

A fluid flow control assembly according to some embodiments may be a bottom hole assembly that can be run into a wellbore using production tubing such that gravel packing and running the production assembly can be completed in a single trip into the wellbore. For example, uphole completion equipment can be run with a fluid flow control assembly in the same trip. The tubing can be spaced and an associated tubing hanger can be landed in a tubing spool prior to packer setting and pumping slurry or other materials for fluid flow control. The fluid flow control assembly can include one or more valves that are controllable by a component positioned at or close to the surface. The valves can be controlled by applying hydraulic pressure through control lines that can be conduits reserved for such pressure control, using electrical signals received from an electrical conductor, using pressure pulse, acoustic, other forms of telemetry, or using a combination of these and other methods.

Fluid flow control assemblies according to some embodiments can be disposed in a bore with a screen assembly. The screen assembly may include a non-perforated portion of a base pipe with an annular flow between disposed between an outer diameter of the base pipe and an inner diameter of a screen. The screen assembly can also include a sleeve positioned at a bottom of the screen. The sleeve can take fluid returns during sand placement, for example, and can include one or more additional production sleeves that are spaced in the screen interval. The production sleeves can be opened for well production. The sleeve and production sleeves may be manual or remotely actuated to open.

Certain fluid flow control assembly embodiments can be used to create a multi-zone system and to control fluid flow in a wellbore without requiring a tubing to be manipulated mechanically. Such sand assemblies may reduce the number of drill pipe trips and the number of service assemblies needed to complete a production interval, potentially saving time and costs. Some embodiments can improve safety by allowing gravel pack pumping with the tubing hanger in place, rather than through a blowout preventer. Furthermore, use of a fluid flow control assembly according to some embodiments can isolate the formation after gravel packing to prevent fluid loss and to reduce time to clean up the well.

These illustrative examples are given to introduce the reader to the general subject matter discussed here and are not intended to limit the scope of the disclosed concepts. The following sections describe various additional embodiments and examples with reference to the drawings in which like numerals indicate like elements, and directional descriptions are used to describe the illustrative embodiments but, like the illustrative embodiments, should not be used to limit the present invention.

FIG. 1 depicts a well system 100 with fluid flow control assemblies according to certain embodiments of the present invention. The well system 100 includes a bore that is a wellbore 102 extending through various earth strata. The wellbore 102 has a substantially vertical section 104 and a substantially horizontal section 106. The substantially vertical section 104 includes a casing string 108 cemented at an upper portion of the substantially vertical section 104. The substantially horizontal section 106 is open hole and extends through a hydrocarbon bearing subterranean formation 110.

A tubing string 112 extends from the surface within wellbore 102. The tubing string 112 can provide a conduit for formation fluids to travel from the substantially horizontal section 106 to the surface. Fluid flow control assemblies 114 and screens 116 are positioned with the tubing string 112 in the substantially horizontal section 106. The screens 116 are shown in an extended position. In some embodiments, screens 116 are sand control screen assemblies that can receive hydrocarbon fluids from the formation, direct the hydrocarbon fluids for filtration or otherwise, and stabilize the formation 110.

A sump packer 118 can be positioned downhole from the screens 116. The sump packer 118 can provide positive depth correlation, and can provide debris management during well perforation. The fluid flow control assemblies 114 are positioned between packers 120 and screens 116 and are in communication with a surface component through a control line 122. The fluid flow control assemblies 114 can each include at least one valve that is controllable by the surface component via the control line 122 to control fluid flow at the fluid flow control assemblies 114.

FIG. 1 depicts a well system having and fluid flow control assemblies 114 and screens 116 positioned in the substantially horizontal section 106. Fluid flow control assemblies 114 according to various embodiments of the present invention can be located in any portion of a well system, including in a substantially vertical portion of a well system that is only a substantially vertical well system or that also includes a deviated portion. Any number of fluid flow control assemblies can be used in a well system. Although FIG. 1 depicts two fluid flow control assemblies 114 for use in two zones defined by packers 120 and sump packer 118, for example, any number of fluid flow control assemblies can be used, including one fluid flow control assembly that can control flow in one zone or in more than one zone.

Figure 2A:
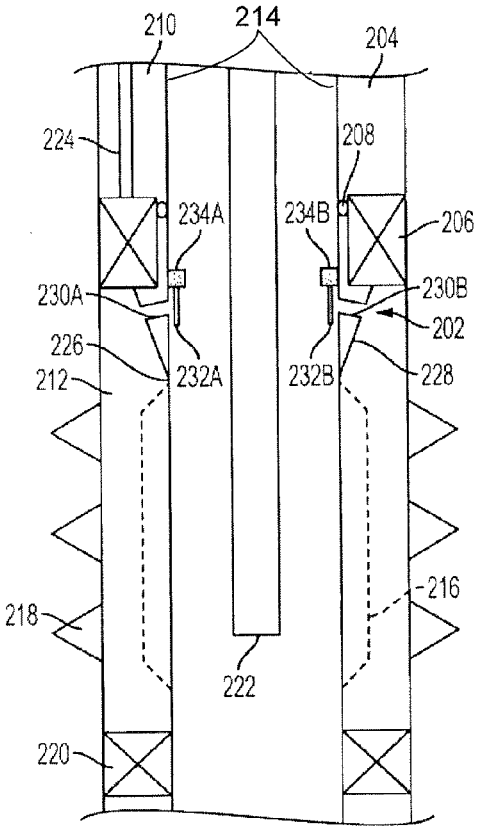
FIG. 2A is a cross-sectional side view of a fluid flow control assembly disposed in a wellbore with a sand control screen according to one embodiment of the present invention.

FIG. 2A schematically depicts a cross section of a fluid flow control assembly 202 in a bore 204 according to one embodiment of the present invention. The fluid flow control assembly 202 can be positioned proximate to packer 206. It can cooperate with packer 206 and seal 208 to control fluid flow between an upper annulus 210 of the bore 204 and lower annulus 212 of the bore, and between an inner diameter of a base pipe 214 and an environment external to the inner diameter of the base pipe 214, such as the lower annulus 212.

The fluid flow control assembly 202 is positioned with respect to a screen 216 that is capable of providing support to a perforated formation 218 at a production interval of the base pipe 214. Sump packer 220 is positioned below the screen 216. A wash pipe 222 is positioned in an inner diameter of the base pipe 214.

The fluid flow control assembly 202 can include various subassemblies that can be capable of controlling fluid flow downhole in response to controls received from a surface component via a communication medium such as (but not limited to) control line 224. The fluid flow control assembly 202 can include an upper extension 226 and a crossover portion 228 having ports 230A-B through which fluid flow can be controlled by valves 232A-B. The valves 232A-B can be coupled to one or more actuators 234A-B that can be hydraulically or electrically actuated, in response to control signals received from the surface component via the control line 224, to cause the valves 232A-B to open or close. In some embodiments, the actuators 234A-B are configured to open one or more of the valves 232A-B partially, in addition to being able to open and close the valves 232A-B. In other embodiments, the fluid flow control assembly 202 can include one actuating device that is capable of controlling the valves 232A-B.

Figure 2B:
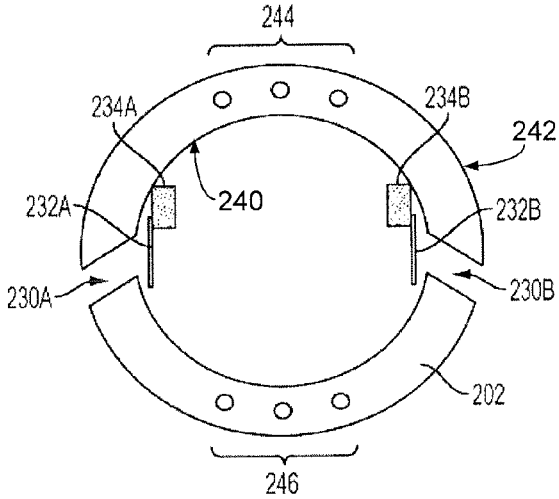
FIG. 2B is a cross-sectional view of the valve and port subassembly of the fluid flow control assembly of FIG. 2A according to one embodiment of the present invention.

FIG. 2B depicts a cross-sectional view of the fluid flow control assembly 202 of FIG. 2A. Ports 230A-B allow fluid communication between an inner diameter 240 and an outer diameter 242. Valves 232A-B can controllably restrict fluid communication through ports 230A-B in response to actuators 234A-B based on control signals received from a surface component. The fluid flow control assembly 202 includes openings 244, 246 that can provide return paths for fluid returning to an upper portion of the bore from a lower portion.

Although FIG. 2A depicts two valves 232A-B, fluid flow control assemblies according to various embodiments of the present invention can include any number of valves that are located at various positions in the fluid flow control assemblies. For example in FIG. 2A, a valve can be located at an upper portion of the packer 206 and/or a valve can be located at a lower portion of the fluid flow control assembly 202.

Valves 232A-B can be any type of device that can controllably block fluid flow. Examples of valves 232A-B include an inner diameter closure mechanism, a gravel exit port closing sleeve, and a return and reversing valve. Inner diameter closure mechanism can include a ball or a sleeve, or both. Various types of valves can be used, including (but not limited to) HS interval control valve ("ICV"), HVC-ICV, and LV-ICV, all available from WellDynamics.

Fluid flow control assemblies according to certain embodiments can be used to reduce the number downhole trips required to run a packing assembly and prepare the well for production. FIGS. 3A-3F depict a fluid flow control assembly 302 in various positions for preparing a well for production. The arrows shown in FIGS. 3A-3F depict fluid flow direction.

The fluid flow control assembly 302 includes ports that are associated with valves 304A-C. The valves 304A-C can be actuated by actuating devices 305A-C in response to control signals, such as hydraulic or electrical signals, received from a surface component via control line 306.

Figure 3D:
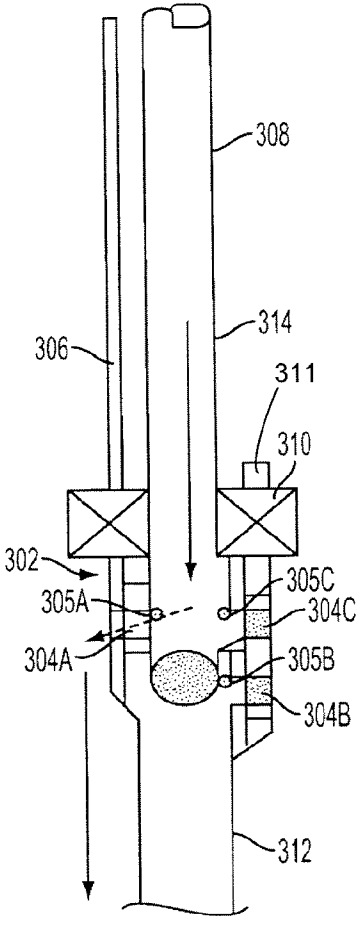
FIG. 3D is a schematic side view illustration of the fluid flow control assembly of FIG. 3A controllably configured in a squeeze position according to one embodiment of the present invention.
Figure 3C:
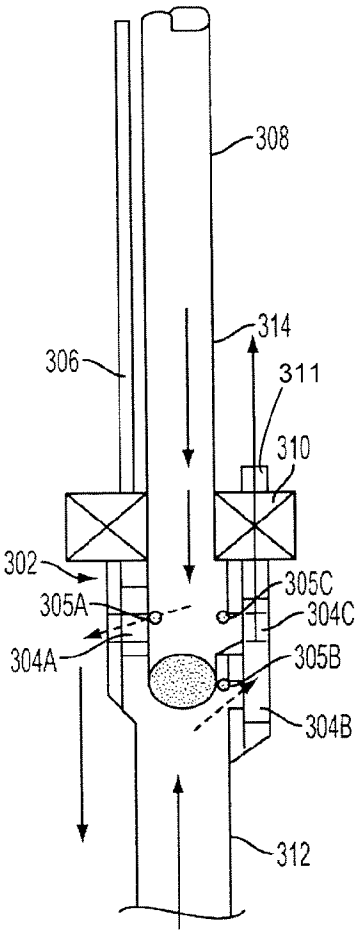
FIG. 3C is a schematic side view illustration of the fluid flow control assembly of FIG. 3A controllably configured in a fluid circulating position according to one embodiment of the present invention.
Figure 3B:
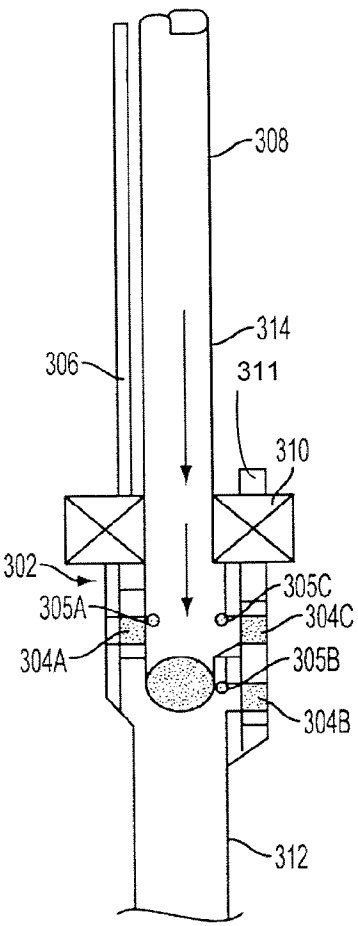
FIG. 3B is a schematic side view illustration of the fluid flow control assembly of FIG. 3A controllably configured in a packer set position according to one embodiment of the present invention.
Figure 3A:
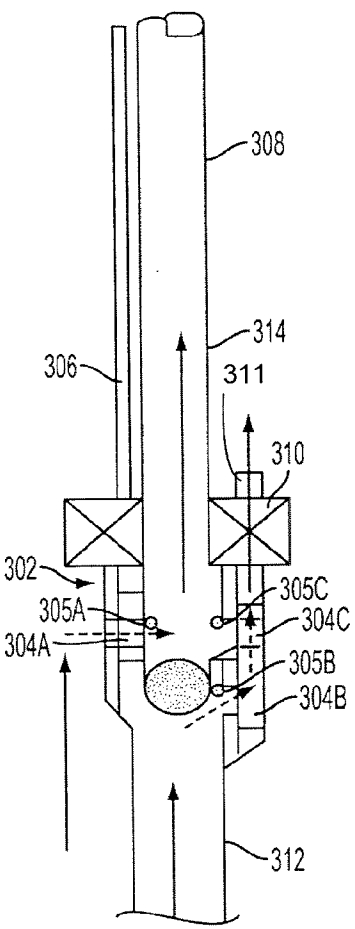
FIG. 3A is a schematic side view illustration of a fluid flow control assembly controllably configured in a run in position via a control line according to one embodiment of the present invention.

FIG. 3A depicts a "run in" position in which production tubing 308 is located downhole with a packer assembly 310 and the fluid flow control assembly 302. In a "run in" position, a control signal can be received from a surface component via the control line 306 to cause the valves 304A-C to actuate to the open position. As the production tubing 308 is positioned downhole, fluids are allowed to flow from a lower portion 312 of the well to an upper portion 314 of the well to facilitate running the production tubing 308.

After the production tubing 308 is run downhole, a packer in the packer assembly 310 can be set and tested via various techniques that can include increasing pressure experienced by the packer assembly 310. Prior to setting and testing the packer, valves 304A-C can be actuated to the closed position as shown in FIG. 3B in response to a signal received via control line 306. Closing the valves 304A-C can provide a pressure seal between the lower portion 312 and the upper portion 314 to allow the packer to be set and tested.

After the packer is set and tested, valves 304A-C can be actuated to the open position as shown in FIG. 3C to allow slurry or other material carrying liquid to flow from the upper portion 314 to the lower portion 312. The slurry can flow out of the port associated with valve 304A, for example, to an area that is external to the production tubing 308. A screen or other similar device (not shown) can be positioned downhole from the fluid flow control assembly 302. The slurry can deposit material in the area that is external to the production tubing 308 and internal to the screen. At least some of the carrier liquid can return via a wash pipe 311 and through ports associated with valves 304B-C.

After packing the area external to the production tubing 308 and internal to the screen, valves 304B-C can be actuated to the closed position in response to hydraulic or electrical control signals received via control line 306 to cause the fluid flow control assembly 302 to be configured into a "squeeze" position as shown in FIG. 3D. In the squeeze position, fluid, which may be frac fluid such as viscous gel mixed with proppant, is forced to the area that is external to the production tubing 308 through the port associated with valve 304A, which is in the open position, and through perforations (not shown) that extend into a formation. The frac fluid can fracture or part the formation to form open void spaces in the formation. Then, a slurry of proppant material is pumped though the port associated with valve 304A and into the formation through the perforations to maintain the perforations in an open position for production.

Figure 3F:
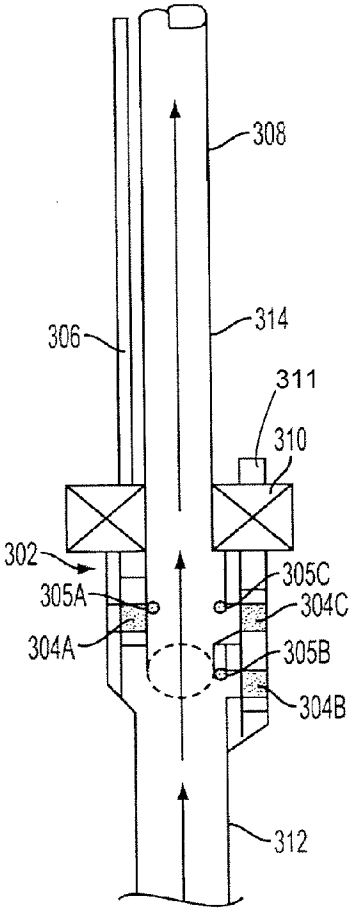
FIG. 3F is a schematic side view illustration of the fluid flow control assembly of FIG. 3A controllably configured in a production position according to one embodiment of the present invention.
Figure 3E:
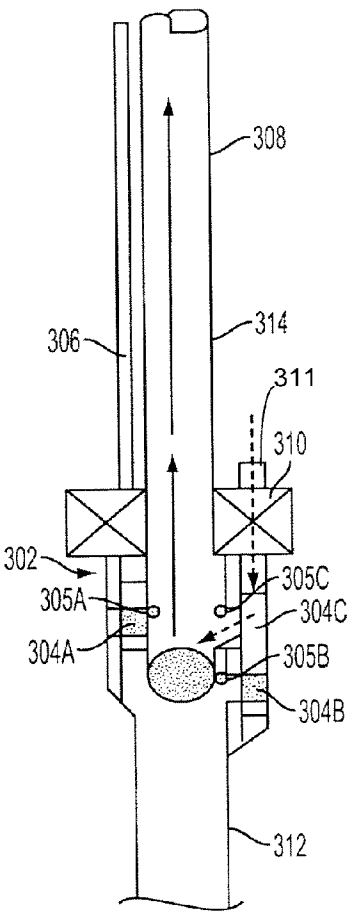
FIG. 3E is a schematic side view illustration of the fluid flow control assembly of FIG. 3A controllably configured in a reverse position according to one embodiment of the present invention.
Figures 4A, 4B, 4C, 4D:
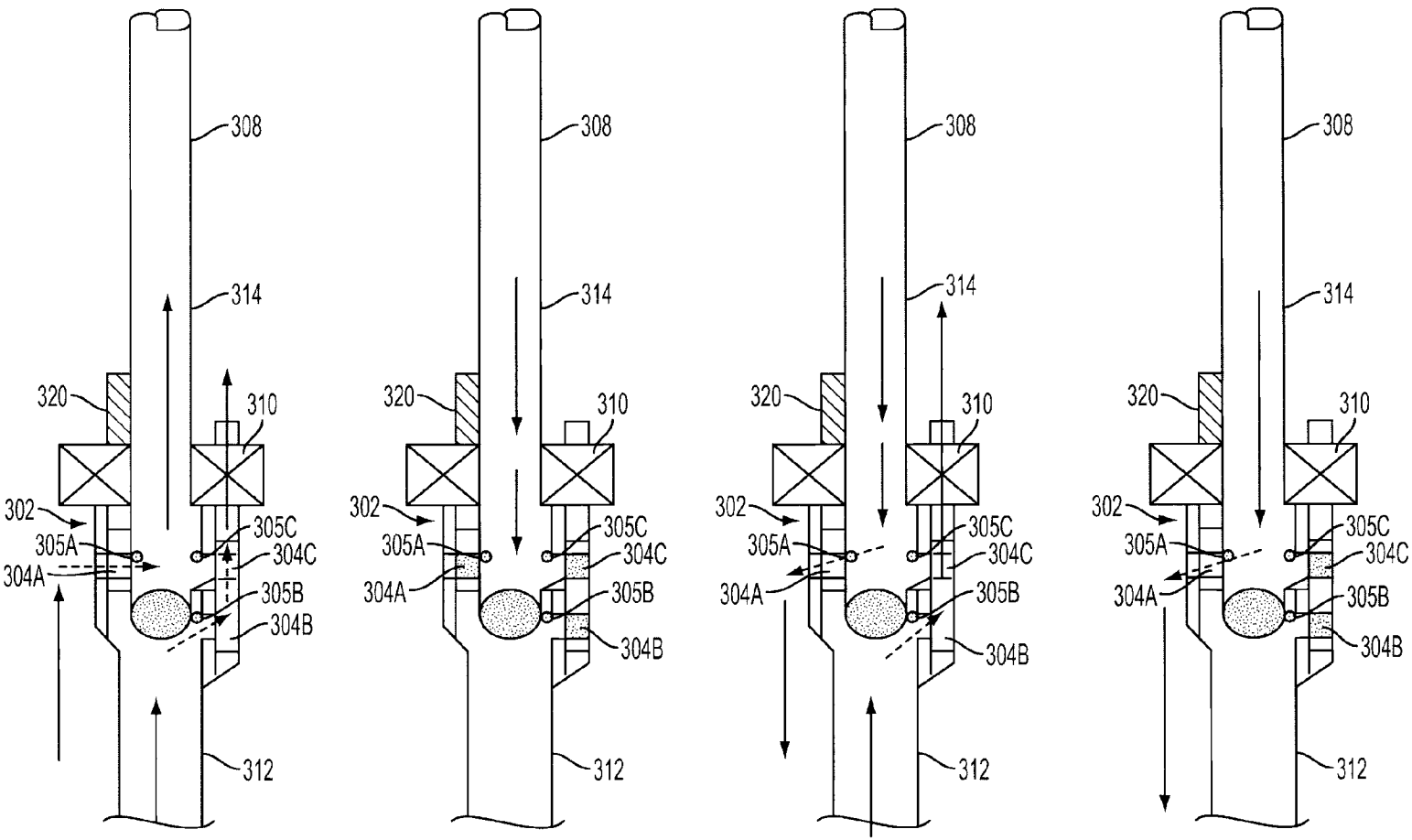
FIG. 4A is a schematic side view illustration of the fluid flow control assembly controllably of FIG. 3A configured in a run in position via a control module according to one embodiment of the present invention.
FIG. 4B is a schematic side view illustration of the fluid flow control assembly of FIG. 3A controllably configured in a packer set position according to one embodiment of the present invention.
FIG. 4C is a schematic side view illustration of the fluid flow control assembly of FIG. 3A controllably configured in a fluid circulating position according to one embodiment of the present invention.
FIG. 4D is a schematic side view illustration of the fluid flow control assembly of FIG. 3A controllably configured in a squeeze position according to one embodiment of the present invention.
Figure 4F:
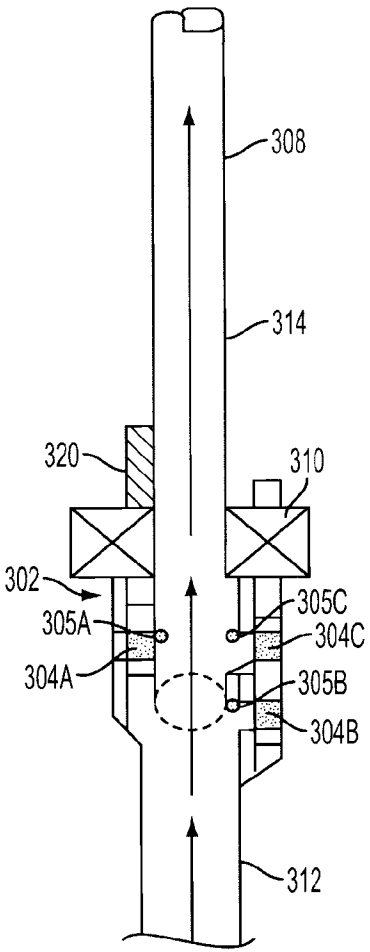
FIG. 4F is a schematic side view illustration of the fluid flow control assembly of FIG. 3A controllably configured in a production position according to one embodiment of the present invention.
Figure 4E:
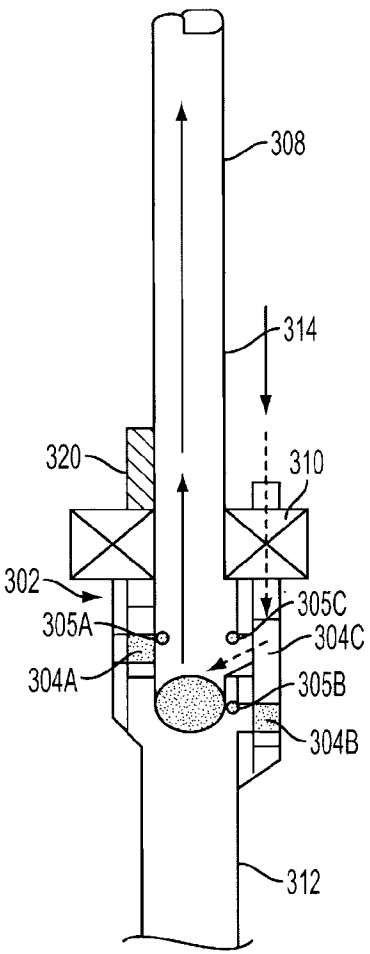
FIG. 4E is a schematic side view illustration of the fluid flow control assembly of FIG. 3A controllably configured in a reverse position according to one embodiment of the present invention.

Valve 304A can be actuated to the closed position and valve 304C can be actuated to the open position in response to hydraulic or electrical control signals received via control line 306 to cause the fluid flow control assembly 302 to be configured in a reverse position as shown in FIG. 3E. A reverse position can minimize fluid injection into the formation and can allow excess slurry to be removed from the wellbore by reverse circulation prior to production.

The valves 304A-C can be actuated to a production mode position depicted in FIG. 3F in response to control signals received via the control line 306. In the production mode, the valves 304A-C can be actuated to a closed position to allow production flows to flow through the open production tubing 308.

Various techniques can be implemented to allow valves according to various embodiments of the present invention to communicate with and be controlled by components positioned at or close to a surface, such as components that are controlled by an operator. In some embodiments, the fluid flow control assembly includes a control module that communicates with the surface component over a communication medium, such as a control line, the production tubing, or wirelessly such as via acoustic telemetry techniques. The control module can interpret the signals and actuate the valves to an open or closed position according to the signals.

Examples of suitable wireless communication techniques include (i) using a strain sensor capable of detecting changes in internal pressure that strain the pope and a series of internal pressure changes within the pipe, as controlled by a surface component; (ii) using a pressure sensor to detect pressure changes imposed by the surface component; (iii) using a sonic sensor or hydrophone to detect sound signatures through the casing or well fluid as generated by the surface component; (iv) using a Hall effect or other magnetic field-type sensor that can receive a signal from a wiper or dart; (v) receiving radio frequency identification ("RFID") signals through fluid; (vi) sensing change in a magnetic field; (vii) sensing an acoustic change caused by an acoustic source in a wiper or dart that is pumped through the inner diameter of the tubing; and (viii) using ionic sensors.

During production, valves 304A-C may continue to be controllably actuated to facilitate hydrocarbon production.

FIGS. 4A-4F depict the fluid flow control assembly 302 of FIGS. 3A-3F in the same various positions for preparing the well for production except that instead of a control line, a control module 320 is provided that can receive signals from a surface component and actuate the valves 304A-C according to those signals. In some embodiments, the control module 320 is electrically powered via battery included with the control module 320 or via an electric/communication line run to the surface. The control module 320 can include circuitry that is capable of processing the received signals into commands for controlling position of the valves 304A-C in accordance with the commands.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A fluid flow control assembly capable of being disposed in a bore of a subterranean formation via a production tubing and adjacent to a packer assembly, comprising:

a plurality of valves comprising:

a first valve in communication with a first actuator, the first valve positionable adjacent to a first port of the production tubing and adapted to allow fluid flow from the production tubing to a screen, a second valve in communication with a second actuator, the second valve positionable between a second port of the production tubing and a wash pipe adjacent to the production tubing and adapted to allow the fluid flow to an upper portion of the bore, the second valve adapted to allow fluid flow between an inner volume of the production tubing and the wash pipe, and a third valve in communication with a third actuator, the third valve positioned downhole from the second valve and positionable adjacent to the wash pipe, the third valve adapted to allow fluid flow between a first portion of the bore and a second portion of the bore further from the surface of the bore than the first portion;

wherein the fluid flow control assembly is configurable to be set to a plurality of positions in accordance with control signals from a surface unit identifying the plurality of positions, wherein the plurality of positions comprises:

the first valve, the second valve, and the third valve being separately actuated to open or closed positions in accordance with respective ones of the control signals; and a set and test position allowing pressure to be applied to the packer assembly;

a reverse position allowing excess slurry to be removed by reverse circulation via the wash pipe and the second port in accordance with control signals identifying the reverse position; and a squeeze position allowing frac fluid to be pumped to a perforated portion of the subterranean formation via the first port in accordance with control signals identifying the squeeze position.

2. The fluid flow control assembly of claim 1, wherein the plurality of valves comprise:

an inner diameter closure mechanism;

a gravel exit port closing sleeve; and a return and reversing valve.

3. The fluid flow control assembly of claim 2, wherein the inner diameter closure mechanism comprises at least one of a ball or a sleeve.

4. The fluid flow control assembly of claim 1, wherein the plurality of actuators are in communication with the surface component through a control line.

5. The fluid flow control assembly of claim 4, wherein the plurality of actuators are in communication with the surface component by at least one of hydraulically or electrically.

6. The fluid flow control assembly of claim 1, wherein the plurality of actuators comprise a plurality of control modules that are electrically powered and configured to process the signals received from the surface component and actuate the plurality of valves in accordance with the signals.

7. The fluid flow control assembly of claim 6, wherein each of the plurality of control modules is configured to receive the signals wirelessly from the surface component.

8. The fluid flow control assembly of claim 1, wherein the fluid flow control assembly is capable of being positioned on the production tubing having the screen and the packer assembly.

9. The fluid flow control assembly of claim 8, wherein the fluid flow control assembly is capable of being positioned uphole from the screen.

10. The fluid flow control assembly of claim 1, comprising a crossover portion having a plurality of ports therethrough, the plurality of valves being capable of controlling fluid flow through the plurality of ports.

11. The fluid flow control assembly of claim 1, wherein one of the first actuator, the second actuator, and the third actuator is configured to control a respective position of a respective one of the first valve, the second valve, and the third valve separately of another of the first actuator, the second actuator, and the third actuator controlling a respective position of another respective one of the first valve, the second valve, and the third valve.

12. The fluid flow control assembly of claim 1, further comprising a plurality of actuators including the first actuator, the second actuator, and the third actuator, wherein each of the plurality of actuators is configured for actuating a respective one of the plurality of valves in response to the signals to cause the fluid flow control assembly to be configured into positions by a single trip through the bore, the positions comprising a run in position, the set and test position, a circulating position, the squeeze position, the reverse position, and a production mode position.

13. A method comprising:

running a production tubing in a bore of a subterranean formation, the production tubing comprising a screen, a fluid flow control assembly, and a packer assembly, the fluid flow control assembly comprising a first valve in communication with a first actuator and a second valve in communication with a second actuator;

responsive to first signals received from a surface component, configuring the fluid flow control assembly to a circulating position by the first actuator actuating the first valve to an open position and the second actuator actuating the second valve to the open position separate from the first actuator actuating the first valve to the open position, to allow slurry comprising a liquid carrier and particulate material to flow to the screen and at least some of the liquid carrier to return to an upper portion of the bore, wherein at least some of the particulate material is deposited internal to the screen; and responsive to second signals received from the surface component, configuring the fluid flow control assembly to a production mode position by the first actuator actuating the first valve to a closed position and the second actuator actuating the second valve to the closed position separate from the first actuator actuating the first valve to the closed position, to allow hydrocarbons to flow to the upper portion of the bore, wherein the hydrocarbons are allowed to flow to the upper portion of the bore through a single trip in the bore.

14. The method of claim 13, further comprising:

response to third signals received from the surface component, configuring the fluid flow control assembly to a packer set and test position by the first actuator actuating the first valve to the closed position and the second actuator actuating the second valve to the closed position separate from the first actuator actuating the first valve to the closed position to allow pressure to be applied to the packer assembly to set and test a packer of the packer assembly;

responsive to fourth signals received from the surface component, configuring the fluid flow control assembly to a squeeze position by the first actuator actuating the first valve to the open position, the second actuator actuating the second valve to the closed position separate from the first actuator actuating the first valve to the open position, and a third actuator actuating a third valve to the closed position separate from the first actuator actuating the first valve to the open position and the second actuator actuating the second valve to the closed position, to allow frac fluid to be pumped to a perforated portion of the subterranean formation; and responsive to fifth signals received from the surface component, configuring the fluid flow control assembly to a reverse position by the first actuator actuating the first valve to the closed position, the second actuator actuating the second valve to the closed position, and the third actuator actuating the third valve to the open position, to allow excess slurry to be removed by reverse circulation prior to production.

15. The method of claim 14, wherein the first actuator, the second actuator, and the third actuator comprise control modules that wirelessly receive signals from the surface component.

16. The method of claim 14, wherein the first actuator, the second actuator, and the third actuator receive signals from the surface component via a control line.

17. An assembly capable of being disposed in a bore of a subterranean formation, the assembly comprising:

a production tubing;

a packer assembly positioned exterior to the production tubing;

a fluid control assembly positioned proximate to the packer assembly, the fluid control assembly comprising a plurality of actuators configured for receiving signals from a surface component, the plurality of actuators comprising a first actuator, a second actuator, and a third actuator;

a plurality of valves, each one valve of the plurality of valves being separately controllable by a respective one actuator of the plurality of actuators in accordance with the signals to control direction of fluid flow in the bore, the plurality of valves comprising:

a first valve in communication with the first actuator, the first valve positioned adjacent to a first port of the production tubing and adapted to allow fluid flow from the production tubing to a screen, a second valve in communication with the second actuator, the second valve positioned adjacent to a second port of the production tubing and adapted to allow fluid flow between an inner volume of the production tubing and a wash pipe of the fluid control assembly, the wash pipe adapted to allow the fluid flow to an upper portion of the bore, and a third valve in communication with the third actuator, the third valve positioned downhole from the second valve and adjacent to the wash pipe, the third valve adapted to allow fluid flow between a first portion of the bore and a second portion of the bore further from the surface of the bore than the first portion, wherein the fluid flow control assembly is configurable to a set and test position allowing pressure to be applied to the packer assembly in accordance with control signals identifying the set and test position by:

the first valve being actuated to a closed position by the first actuator in accordance with a first one of the control signals identifying the set and test position, the second valve being actuated to a closed position by the second actuator in accordance with a second one of the control signals identifying the set and test position, and the third valve being actuated to a closed position by the third actuator in accordance with a third one of the control signals identifying the set and test position;

wherein the fluid flow control assembly is configurable to a squeeze position allowing frac fluid to be pumped to a perforated portion of the subterranean formation via the first port in accordance with control signals identifying the squeeze position by:

the first valve being actuated to an open position by the first actuator in accordance with a first one of the control signals identifying the squeeze position, the second valve being actuated to the closed position by the second actuator in accordance with a second one of the control signals identifying the squeeze position, and the third valve being actuated to the closed position by the third actuator in accordance with a third one of the control signals identifying the squeeze position, wherein the fluid flow control assembly is configurable to a reverse position allowing excess slurry to be removed by reverse circulation via the wash pipe and the second port in accordance with control signals identifying the reverse position by:

the first valve being actuated to the closed position by the first actuator in accordance with a first one of the control signals identifying the reverse position, the second valve being actuated to the open position by the second actuator in accordance with a second one of the control signals identifying the reverse position, and the third valve being actuated to the closed position by the third actuator in accordance with a third one of the control signals identifying the reverse position.

18. The assembly of claim 17, wherein each of the plurality of actuators is configured to receive signals from the surface component at least one of wirelessly or via a control line.

19. The assembly of claim 18, wherein each of the plurality of control modules is in communication with the surface component by at least one of hydraulically or electrically.

* * * * *